US010961754B2

(12) United States Patent
Adams

(10) Patent No.: US 10,961,754 B2
(45) Date of Patent: Mar. 30, 2021

(54) GATE HOLD OPEN DEVICE

(71) Applicant: Eric Buck Adams, Readyville, TN (US)

(72) Inventor: Eric Buck Adams, Readyville, TN (US)

( * ) Notice: Subject to any disclaimer, the term of this patent is extended or adjusted under 35 U.S.C. 154(b) by 347 days.

(21) Appl. No.: 15/922,845

(22) Filed: Mar. 15, 2018

(65) Prior Publication Data

US 2019/0085605 A1 Mar. 21, 2019

Related U.S. Application Data

(60) Provisional application No. 62/471,752, filed on Mar. 15, 2017.

(51) Int. Cl.
*E05C 17/44* (2006.01)
*E05B 65/00* (2006.01)

(52) U.S. Cl.
CPC ..... *E05C 17/44* (2013.01); *E05B 65/0007* (2013.01); *E05C 17/443* (2013.01)

(58) Field of Classification Search
CPC ... Y10T 292/23; Y10T 292/34; Y10T 292/37; Y10T 292/373; Y10T 292/379; Y10T 292/388; Y10T 292/394; Y10T 292/397; Y10T 292/71; Y10T 292/73; Y10T 292/65; Y10T 292/67; E05C 17/00; E05C 17/02; E05C 17/04; E05C 17/045; E05C 17/12; E05C 17/16; E05C 17/166; E05C 17/44; E05C 17/443; E05C 17/446; E05C 17/54; E05C 19/003; E05C 19/004; E05C 19/005; E05B 65/0007; E06B 11/021; E06B 11/00; E06B 11/02; Y10S 292/15
See application file for complete search history.

(56) References Cited

U.S. PATENT DOCUMENTS

| | | | | | |
|---|---|---|---|---|---|
| 384,715 | A * | 6/1888 | Reisse | E05C 17/443 | 292/338 |
| 4,607,253 | A * | 8/1986 | Wooten | E05C 19/004 | 200/61.93 |
| 5,865,484 | A * | 2/1999 | Johns | E05C 19/182 | 292/288 |
| 2010/0319160 | A1* | 12/2010 | Rooney | E05C 17/443 | 16/82 |
| 2013/0256324 | A1* | 10/2013 | Meacham | B65D 45/28 | 220/694 |
| 2018/0087301 | A1* | 3/2018 | Curry | E05C 17/44 | |

* cited by examiner

*Primary Examiner* — Alyson M Merlino
(74) *Attorney, Agent, or Firm* — Mark A. Pitchford; Eric B. Fugett; Pitchford Fugett, PLLC

(57) ABSTRACT

A gate hold open device is configured to hold the gate open at any point along the swing of the gate. A mounting bracket hingedly secures one end of a prop leg to the gate. A sliding handle hangs from the gate to secure the prop leg to the gate when the gate is in a closed position and the device is disengaged or stored. The sliding handle is lifted from the gate such that the prop leg can pivot or rotate about the mounting bracket and fall to the ground. The gate can then be flung open, and the prop leg will drag along the ground until the gate begins to swing back toward the closed position. The prop leg jams into the ground, holding the gate open until a user lifts the prop leg and hangs the sliding handle back on the gate.

18 Claims, 6 Drawing Sheets

GATE HOLD OPEN DEVICE

CROSS-REFERENCES TO RELATED APPLICATIONS

This application claims priority to U.S. Provisional Patent Application Ser. No. 62/471,752 entitled "GATE HOLD OPEN DEVICE" filed on Mar. 15, 2017.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present invention relates generally to devices and methods for holding gates or doors open. More particularly, this invention pertains to a device for holding a gate open at any position along the gate's swing.

Long gates (e.g., in excess of 8 feet wide) such as those used on farms tend to sag over time which causes them to close automatically. This makes driving through an open gate difficult unless multiple people are present (one to drive and one to hold the gate open). However, most farmers and ranchers generally work alone. Some devices exist for holding gates open. However, these devices require the user to walk the gate all the way open and then tie the gate to an object or deploy a rod to hold the gate in that position. The rod extends straight down from the gate and when wind or an animal pushes the gate further open or closed, damage to the gate and hold back device occurs (e.g., bending the rod).

BRIEF SUMMARY OF THE INVENTION

Aspects of the present invention provide a gate hold open device configured to hold the gate open at any point along the swing of the gate. The gate hold open device includes a mounting bracket, a prop leg, and a sliding handle. The mounting bracket hingedly secures one end of the prop leg to the gate. The sliding handle hangs from the gate to secure the prop leg to the gate when the gate is in a closed position and the device is disengaged or stored. The sliding handle is lifted from the gate such that the prop leg can pivot or rotate about the mounting bracket and fall to the ground. The gate can then be flung open, and the prop leg will drag along the ground until the gate begins to swing back toward the closed position. The prop leg jams into the ground, holding the gate open until a user lifts the prop leg and hangs the sliding handle back on the gate to secure the hold open device in the disengaged position.

In one aspect, a gate hold open device includes a mounting bracket, a prop leg, and a sliding handle. The mounting bracket is configured to secure to a lower mounting point of a gate. The prop leg has a proximal end and a distal end. The prop leg is configured to hingedly engage the mounting bracket at the proximal end of the prop leg. The sliding handles configured to slide along the prop leg toward the proximal end of the prop leg when the device is in a first position and toured the distal end of the prop leg when the devices in a second position.

In another aspect, a method of engaging a gate hold open device includes lifting a sliding handle of the device from an upper crossbeam of a gate to which the device is mounted. The user moves the sliding handle away from the upper crossbeam of the gate such that a handle of the sliding handle will not reengage crossbeams of the gate when released by the user. The user releases the sliding handle such that a prop leg of the gate upon which the device is located drops to the ground by rotating about a mounting bracket of the device affixed to a lower crossbeam of the gate. The user throws or flings the gate toward an open position.

In another aspect, a method of disengaging a gate hold open device includes lifting a prop leg of the device from ground adjacent the gate by handle of a sliding handle on the prop leg such that the prop leg rotates up about a mounting bracket of the device affixed to a lower crossbeam of the gate. The user raises the sliding handle of the device toward a distal end of the prop leg. The user rotates the prop leg up about the mounting bracket such that the prop leg is positioned nearly parallel to the gate. The user lowers the handle onto an upper crossbeam of the gate such that the sliding handle hangs from the upper crossbeam by the handle and secures the prop leg to the gate, preventing the distal end of the prop leg from contacting the ground. The user then secures the gate in the closed position.

BRIEF DESCRIPTION OF THE SEVERAL VIEWS OF THE DRAWINGS

Reference will now be made in detail to optional embodiments of the invention, examples of which are illustrated in accompanying drawings. Whenever possible, the same reference numbers are used in the drawing and in the description referring to the same or like parts.

DETAILED DESCRIPTION OF THE INVENTION

Figure 1:
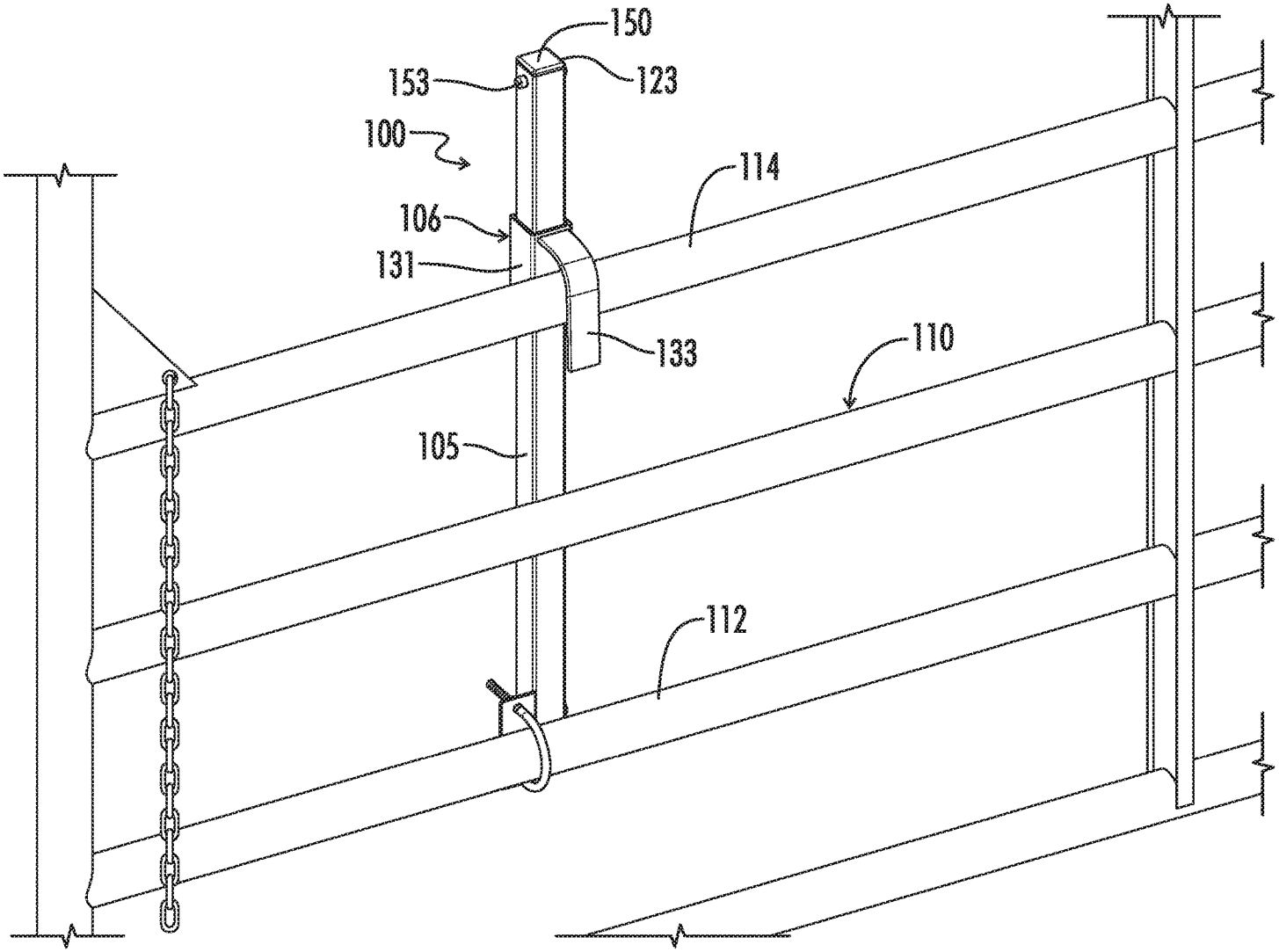
FIG. 1 is a rear isometric view of a gate hold open device in a first, disengaged position.
Figure 2:
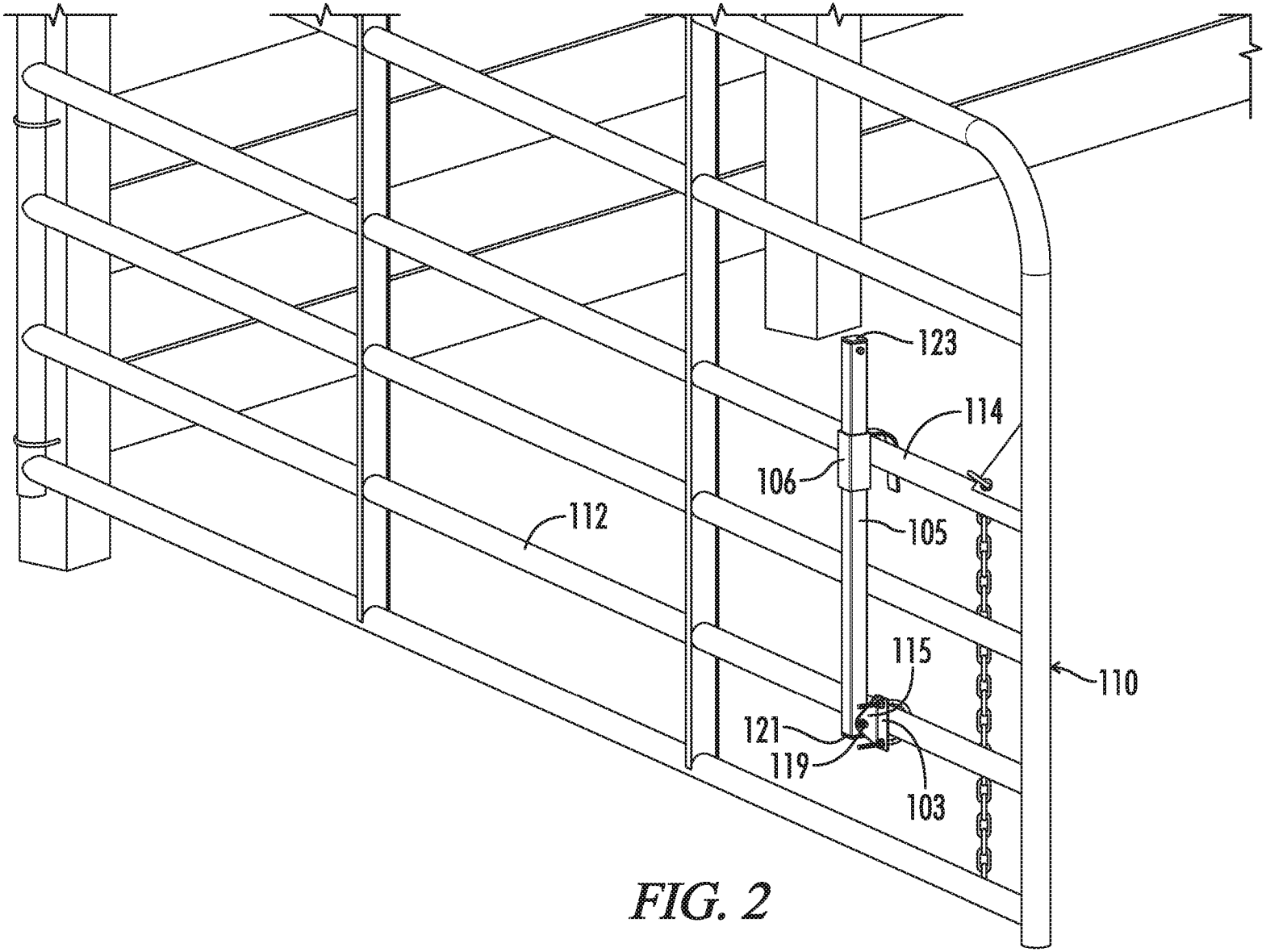
FIG. 2 is a front isometric view of the gate hold open device of FIG. 1 in the first, disengaged position.
Figure 3:
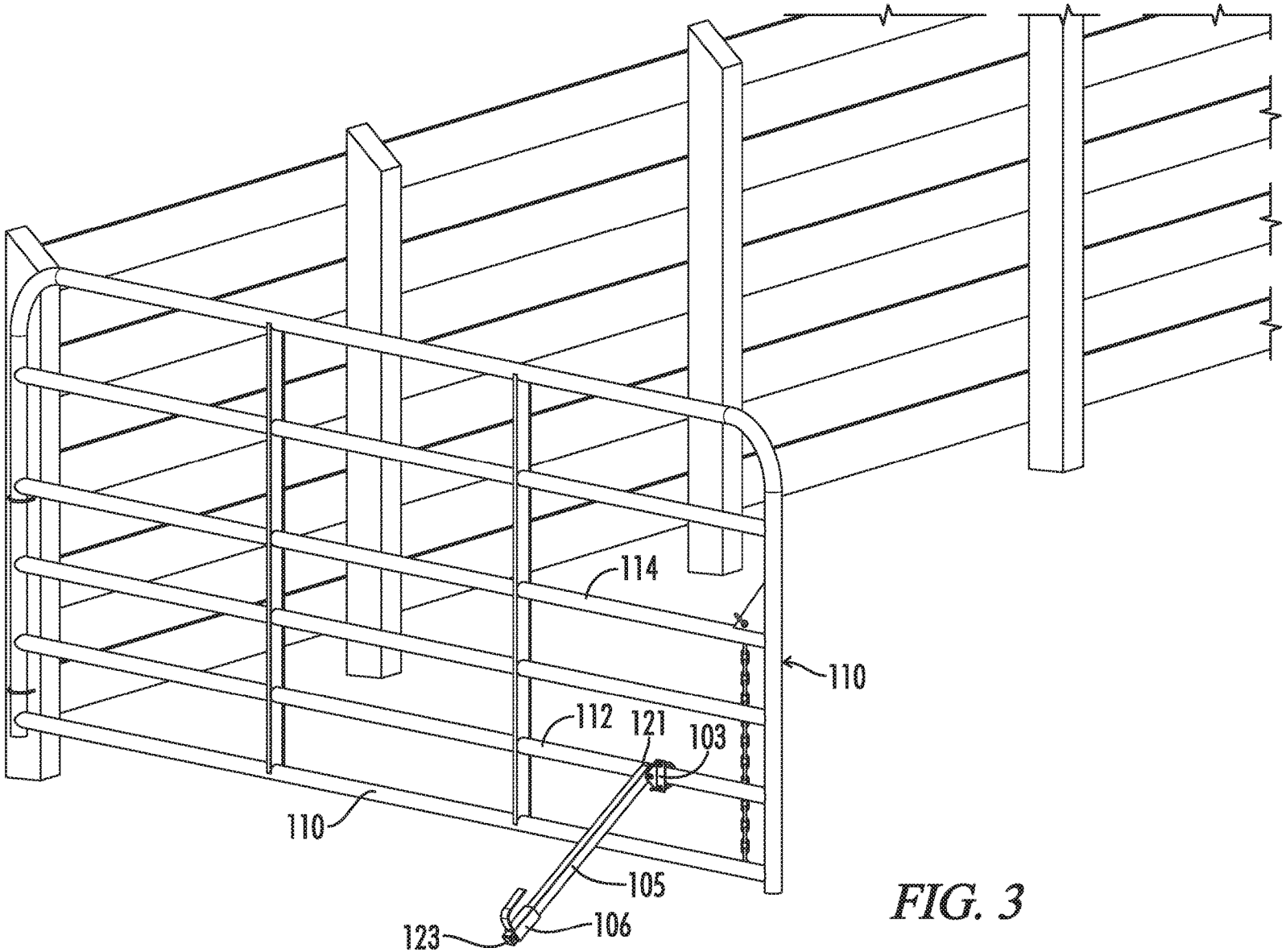
FIG. 3 is a front isometric view of the gate hold open device of FIGS. 1 and 2 in a second, engaged position.
Figure 4:
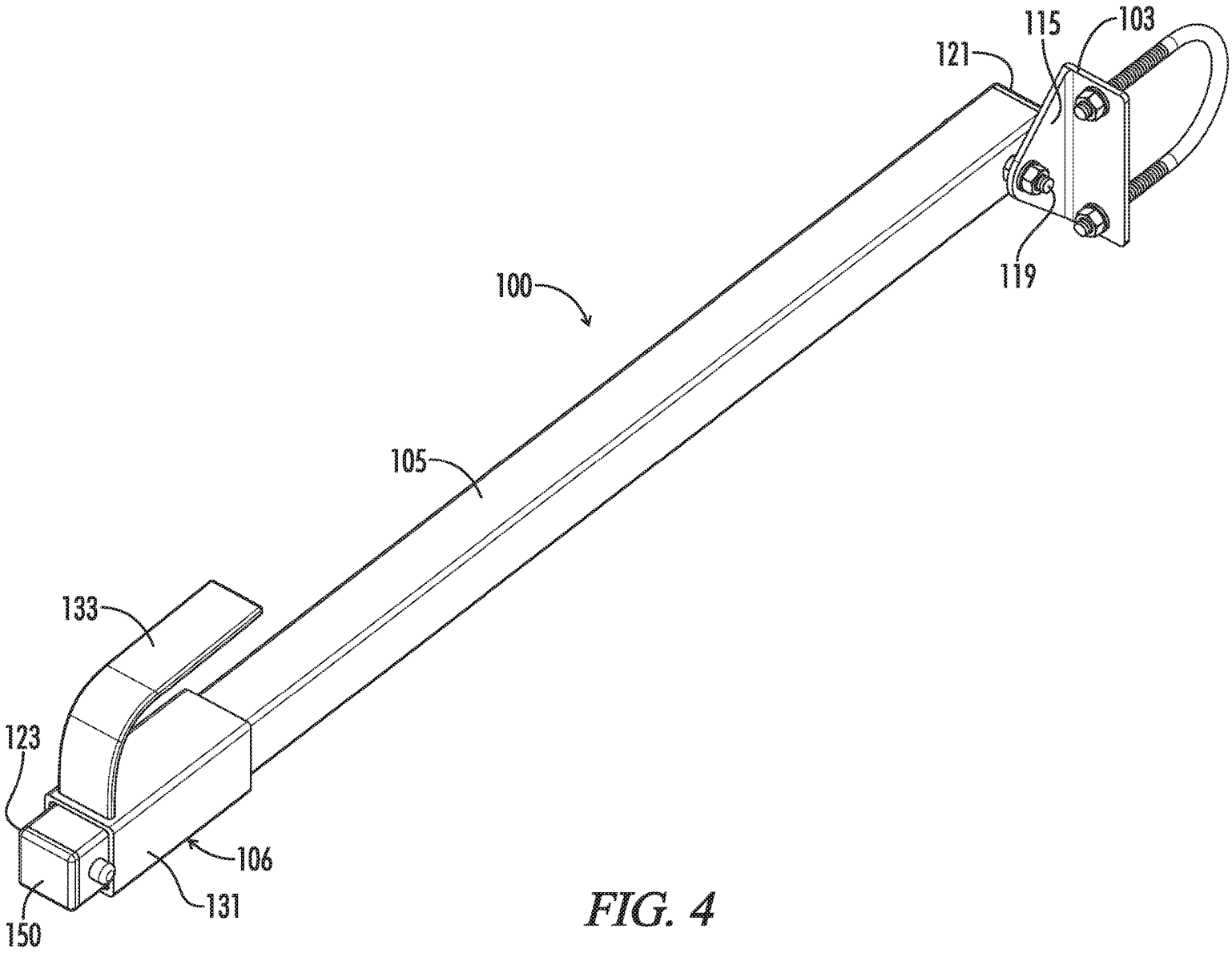
FIG. 4 is an isolated a rear isometric view of the gate hold open device of FIGS. 1-3.

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

To facilitate the understanding of the embodiments described herein, a number of terms are defined below. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims.

As described herein, an upright position is considered to be the position of apparatus components while in proper operation or in a natural resting position as described herein (e.g., in the first, disengaged position). Vertical, horizontal, above, below, side, top, bottom and other orientation terms are described with respect to this upright position during operation unless otherwise specified. The term "when" is used to specify orientation for relative positions of components, not as a temporal limitation of the claims or apparatus described and claimed herein unless otherwise specified. The terms "above", "below", "over", and "under" mean "having an elevation or vertical height greater or lesser than" and are not intended to imply that one object or component is directly over or under another object or component.

The phrase "in one embodiment," as used herein does not necessarily refer to the same embodiment, although it may. Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

In one embodiment, a gate hold open device is operated by unlocking the gate (to which the device is mounted) and simply slinging the gate open. The gate drags the device along the ground until the momentum is used up and the gate tries to move back to closed. At this point, the device is forced into the ground and retains the gate in a generally open position. If an animal or other source (e.g., wind) pushes the gate further open, then the device will hold the gate open at the new position without any damage. Trying to close the gate the device deployed digs the device further into the ground and prevents closing of the gate. This gate hold open device is designed to fit many styles of gates, not just metal gates. The device uses a swing leg prop to engage the ground and prevent travel in one direction (the closing direction). The device can then be hung back on the gate and the gate closed once the user has used the gate (e.g., driven a vehicle through the gate).

Figure 5:
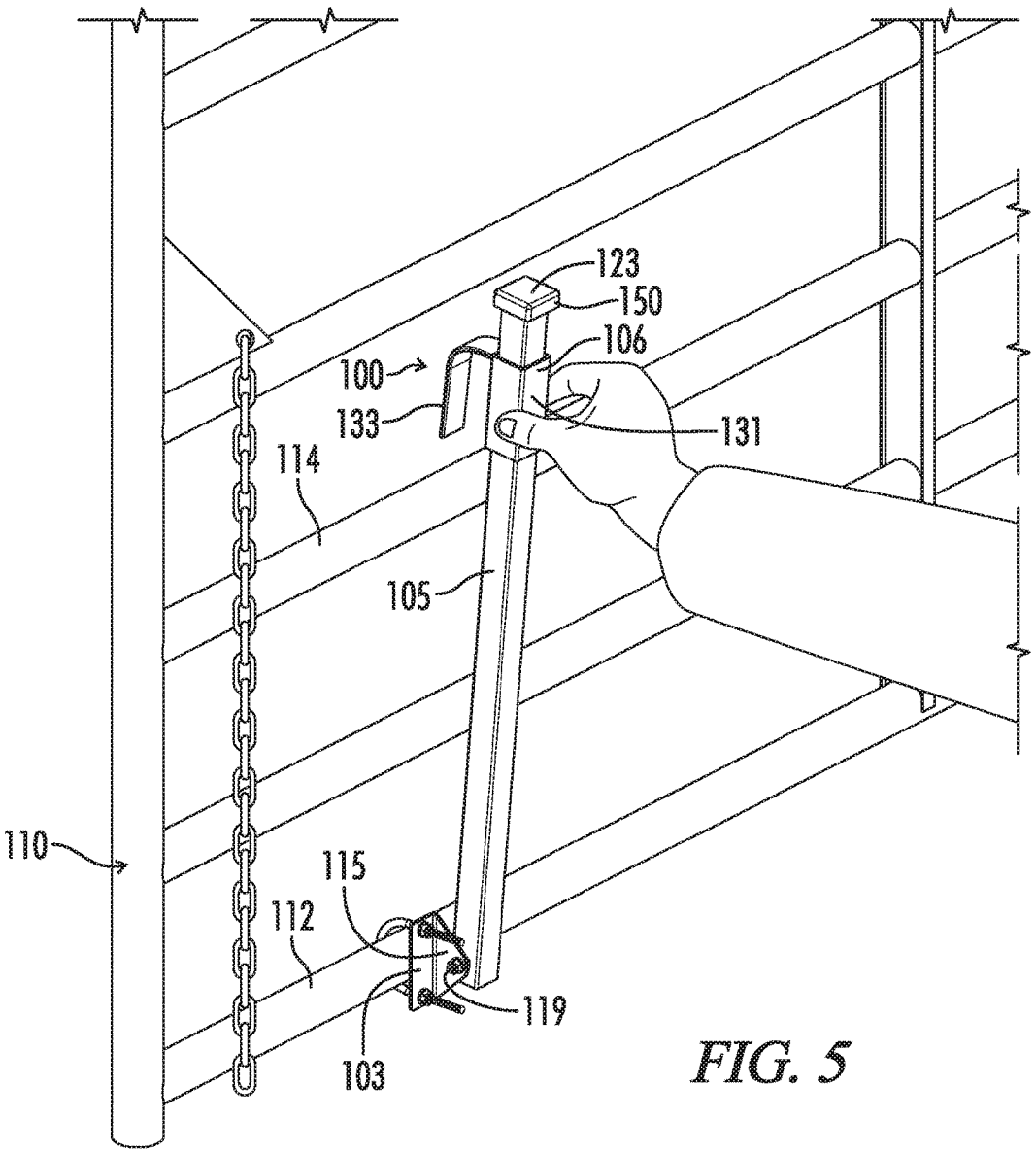
FIG. 5 is a front isometric view of a gate hold open device being moved from between a disengaged position and an engaged position.
Figure 6:
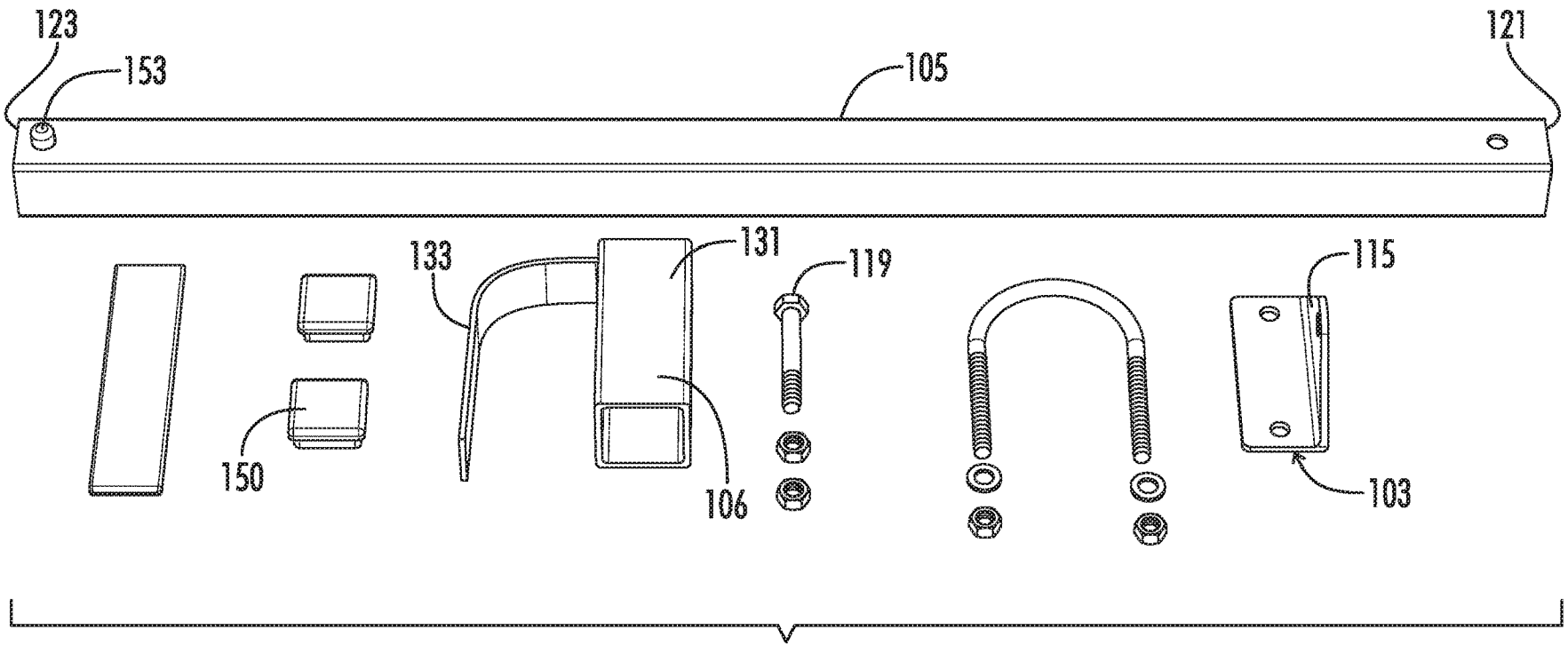
FIG. 6 is a parts view of the gate hold open device of FIGS. 1-4.

Referring now to FIGS. 1-6 and particularly FIG. 5, a gate hold open device 100 includes a mounting bracket 103, a prop leg 105, and a sliding handle 106. The mounting bracket 103 is secured to a lower mounting point or lower crossbeam 112 of a gate 110. The prop leg 105 is secured to the mounting bracket 103 in a hinged fashion via bolt 119 through a hole in a first tab 115 of the mounting bracket 103, a pair of holes through the prop leg, and through a hole in a second tab (not visible) of the mounting bracket 103. The mounting bracket 103 has a plurality of holes therehrough that may receive a u-bolt to mount the bracket 103 to a crossbeam 112 of the gate 110, or screws for mounting the mounting bracket 103 to a stamped metal gate or wooden gate.

The sliding handle 106 slides up and down on the leg prop 105 and serves as a hanger when the device 100 is not in use (i.e., is disengaged) and as a handle for lifting the prop leg 105 when the device 100 is in use (i.e., is engaged).

In one embodiment, the gate hold open device 100 includes a mounting bracket 103, a prop leg 105, and a sliding handle 106. The mounting bracket 103 is configured to secure to a lower mounting point 112 of a gate 110. In one embodiment, the lower mounting point 112 of the gate 110 is a lower crossbeam of the gate 110. In one embodiment, the mounting bracket 103 is attached to the gate 110 opposite a hinge of the gate 110. In one embodiment, the mounting bracket 103 includes at least one tab 115. The prop leg 105 hingedly engages the mounting bracket 103 via a pin 119 through the prop leg 105 at the proximal end 121 of the prop leg 105. In one embodiment, the pin 119 is a bolt. In one embodiment, the mounting bracket 103 has a first tab 115 and a second tab, and the prop leg 105 hingedly engages the mounting bracket 103 via a bolt 119 inserted through a hole in the first tab 115, a pair of holes in the prop leg 105, and a hole in the second tab.

The prop leg 105 has a proximal end 121 and a distal end 123. The prop leg 105 is configured to hingedly engage the mounting bracket 103 at the proximal end 121 of the prop leg 105. In the first disengaged position, the prop leg 105 is configured to be retained generally parallel to a plane formed by the gate 110. In the second engaged position, probably one of 5 is configured to contact the ground under (e.g., below and adjacent to) the gate 110 such that the prop leg 105 prevents the gate 110 from closing. In one embodiment, the prop leg 105 is configured to contact the ground at an angle of between 15° and 75° to the ground (preferably between approximately 30° and 45°). In one embodiment, the prop leg 103 is formed from a length of square tubing having an external dimension (e.g cross-sectional width or length).

The sliding handle 106 is configured to slide along the prop leg 105 toward the proximal end 121 of the prop leg 105 when the device 100 when the device 100 is in a first position (i.e., disengaged position) and toward the distal end 123 of the prop leg 105 when the device 100 is in a second position (i.e. engaged position). The sliding handle 106 is configured to attach to an upper crossbeam 114 of the gate 110 when the device 100 is in the first position. In one embodiment, the sliding handle 106 attaches to the upper crossbeam 114 by hooking onto and hanging from the upper crossbeam 114. In another embodiment, the sliding handle 106 attaches to the upper crossbeam 114 via a magnet. Attaching the siding handle 106 to the upper crossbeam 114 prevents the prop leg 105 from contacting the ground. In one embodiment, the sliding handle includes a tube 131 having an internal dimension greater than the corresponding external dimension of the prop leg 105 such that the tube 131 fits about the prop leg 105 and is able to slide along the prop leg 105. In one embodiment, the handle 133 extends from the tube 131 of the sliding handle 106. The handle 133 forms a hook for engaging the upper mounting point 114 (e.g., upper crossbar) of the gate 110 when the device 100 is in the disengaged position. In one embodiment, the handle 133 extends from the square tubing 131 of the sliding handle 106 at a distal end 123 of the square tubing of the sliding handle toward a proximal end 121 of the square tubing 131 of the sliding handle 106 such that the handle 133 forms of hook for engaging the upper mounting point 114 of the gate 110 when the device 100 is in the disengaged position. The handle 133 further forms a grab handle for lifting the prop leg 105 from the ground when the device 100 is in the second, engaged position. In one embodiment, the internal dimension of the square tubing 131 of the sliding handle 106 is sized to prevent rotation of the sliding handle 106 about the square tube of the prop leg 105.

In one embodiment, the device 100 further includes a cap 150 configured to close the distal end of the prop leg 105. In one embodiment, the cap 150 has an external dimension greater than the internal dimension of the tube 131 of the sliding handle 106 such that when the cap 150 is attached to the distal end 123 of the prop leg 105, the sliding handle 106 cannot be removed from the prop leg 105 by sliding the sliding handle 106 off of the prop leg 105 at the distal end 123 of the prop leg 105. In another embodiment, a retainer pin 153 protrudes from the prop leg 105 at the distal end 123 of the prop leg 105 to retain the sliding handle 106 on the prop leg 105.

Rubber bumpers and caps may be added to various components to reduce rattle of the device 100 internally, as well as against the gate 110.

In one embodiment, a method of engaging the gate hold open device 100 includes lifting the sliding handle 106 of the device 100 from the upper crossbeam 114 of the gate 110. A user moves the sliding handle 106 away from the upper crossbeam 114 of the gate 110 (see FIG. 5) such that the handle 133 of the sliding handle 106 will not reengage crossbeams of the gate 110 when released. The user releases the sliding handle 106 such that the prop leg 105 of the gate 110 upon which the device 100 is mounted drops to the ground by rotating about the mounting bracket 103 of the device 100 affixed to the lower crossbeam 112 of the gate 110. The user then throws or flings the gate 110 toward an open position of the gate 110.

In one embodiment, a method of disengaging the gate hold open device 100 includes lifting the prop leg 105 of the device 100 from the ground adjacent the gate 110 by the handle 133 of the sliding handle 106 on the prop leg 105 such that the prop leg 105 rotates up about the mounting bracket 103 of the device 100 affixed to the lower crossbeam 114 of the gate 110. The user raises the sliding handle 106 of the device 100 toward the distal end 123 of the prop leg 105. The user then rotates the prop leg 105 up about the mounting bracket 103 such that the prop leg 105 is positioned generally parallel to the gate 110. The user lowers the handle 133 onto the upper crossbeam 114 of the gate 110 such that the sliding handle 106 hangs from the upper crossbeam 114 and secures the prop leg 105 to the gate 110, preventing the distal end 123 of the prop leg 105 from contacting the ground. The user then secures the gate 110 in the closed position.

This written description uses examples to disclose the invention and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims It will be understood that the particular embodiments described herein are shown by way of illustration and not as limitations of the invention. The principal features of this invention may be employed in various embodiments without departing from the scope of the invention. Those of ordinary skill in the art will recognize numerous equivalents to the specific procedures described herein. Such equivalents are considered to be within the scope of this invention and are covered by the claims.

All of the compositions and/or methods disclosed and claimed herein may be made and/or executed without undue experimentation in light of the present disclosure. While the compositions and methods of this invention have been described in terms of the embodiments included herein, it will be apparent to those of ordinary skill in the art that variations may be applied to the compositions and/or methods and in the steps or in the sequence of steps of the method described herein without departing from the concept, spirit, and scope of the invention. All such similar substitutes and modifications apparent to those skilled in the art are deemed to be within the spirit, scope, and concept of the invention as defined by the appended claims Thus, although there have been described particular embodiments of the present invention of a new and useful GATE HOLD OPEN DEVICE it is not intended that such references be construed as limitations upon the scope of this invention except as set forth in the following claims

What is claimed is:

1. A gate hold open device in combination with a gate, said device comprising:

a mounting bracket configured to secure to a lower mounting point of the gate;

a prop leg having a proximal end and a distal end, wherein the prop leg is configured to hingedly engage the mounting bracket at the proximal end of the prop leg; and a sliding handle configured to slide along the prop leg toward the proximal end of the prop leg when the device is in a first position and toward the distal end of the prop leg when the device is in a second position, wherein:

the first position is a disengaged position;

the second position is an engaged position; and in the first, disengaged position, the sliding handle is configured to hook onto an upper mounting point of the gate such that the prop leg cannot contact the ground.

2. The device in combination with the gate of claim 1, wherein:

the gate has a lower crossbeam and an upper crossbeam; and the lower mounting point is the lower crossbeam.

3. The device in combination with the gate of claim 1, wherein:

the gate has a lower crossbeam and an upper crossbeam, wherein the upper crossbeam includes the upper mounting point of the gate;

the sliding handle is configured to hook onto the upper crossbeam when the device is in the first, disengaged position; and the sliding handle is hooked onto the upper crossbeam by hanging from the upper crossbeam.

4. The device in combination with the gate of claim 1, wherein:

in the second, engaged position, the prop leg is configured to contact the ground.

5. The device in combination with the gate of claim 1, wherein:

in the second, engaged position, the prop leg is configured to contact the ground and said contact with the ground prevents the gate from closing.

6. The device in combination with the gate of claim 1, wherein:

in the second, engaged position, the prop leg is configured to contact the ground.

7. The device in combination with the gate of claim 1, wherein:

the mounting bracket comprises at least one tab; and the prop leg hingedly engages the at least one tab via a pin through the prop leg at the proximal end of the prop leg.

8. The device in combination with the gate of claim 1, wherein:

the mounting bracket comprises a first tab and a second tab; and the prop leg hingedly engages the mounting bracket via a pin inserted through a hole in the first tab, a pair of holes in the prop leg, and a hole in the second tab.

9. The device in combination with the gate of claim 1, wherein:

the mounting bracket comprises a first tab and a second tab; and the prop leg hingedly engages the mounting bracket via a bolt inserted through a hole in the first tab, a pair of holes in the prop leg, and a hole in the second tab.

10. The device in combination with the gate of claim 1, wherein:

in the second, engaged position, the prop leg is configured to contact the ground at an angle of between 15 and 75 degrees relative to the ground.

11. The device in combination with the gate of claim 1, wherein:

the sliding handle comprises a tube having an internal dimension greater than a corresponding external dimension of the prop leg such that the tube fits about the prop leg.

12. The device in combination with the gate of claim 1, wherein the sliding handle comprises:

a tube having an internal dimension greater than a corresponding external dimension of the prop leg such that the tube fits about the prop leg and is able to slide along the prop leg; and a handle extending from the tube, said handle forms a hook for hooking onto the upper mounting point of the gate when the device is in the first, disengaged position.

13. The device in combination with the gate of claim 1, wherein:

the sliding handle comprises a tube having an internal dimension greater than a corresponding external dimension of the prop leg such that the tube fits about the prop leg; and the device further comprises a cap configured to close the distal end of the prop leg.

14. The device in combination with the gate of claim 1, wherein:

the sliding handle comprises a tube having an internal dimension greater than a corresponding external dimension of the prop leg such that the tube fits about the prop leg; and the device further comprises a cap configured to close the distal end of the prop leg, said cap having an external dimension greater than the internal dimension of the tube of the sliding handle such that when the cap is attached to the distal end of the prop leg, the sliding handle cannot be removed from the prop leg by sliding the sliding handle off of the prop leg at the distal end of the prop leg.

15. The device in combination with the gate of claim 1, wherein:

the sliding handle comprises a tubing formed of square tubing;

the prop leg is formed of a length of square tubing;

the square tubing of the sliding handle has an internal dimension greater than a corresponding external dimension of the square tubing of the prop leg such that the square tubing of the sliding handle fits about the length of the square tubing of the prop leg; and the device further comprises a stop at the distal end of the prop leg, said stop configured to prevent the sliding handle from sliding off of the length of the square tubing of the prop leg at the distal end of the prop leg.

16. The device in combination with the gate of claim 1, wherein:

the sliding handle comprises a tube formed of square tubing;

the prop leg is formed of a length of square tubing;

the square tubing of the sliding handle has an internal dimension greater than a corresponding external dimension of the square tubing of the prop leg such that the tube fits about the prop leg and is able to slide along the prop leg;

the sliding handle further comprises a handle extending from the square tubing of sliding handle at a distal end of the square tubing of the sliding handle toward a proximal end of the square tubing of the sliding handle such that the handle forms a hook for hooking onto the upper mounting point of the gate when the device is in the first, disengaged position and a grab handle for lifting the prop leg from the ground when the device is in the second, engaged position; and the internal dimension of the square tubing of the sliding handle is sized to prevent rotation of the sliding handle about the square tube of the prop leg.

17. A method of engaging a gate hold open device, said method comprising:

lifting a sliding handle of the device out of engagement with an upper crossbeam of a gate;

moving the sliding handle away from the upper crossbeam of the gate such that a handle of the sliding handle will not re-engage other crossbeams of the gate when released;

releasing the sliding handle such that a prop leg of the device, upon which the sliding handle is located, drops to the ground by rotating about a mounting bracket of the device affixed to a lower crossbeam of the gate; and throwing the gate toward an open position.

18. A method of disengaging a gate hold open device, said method comprising:

lifting a prop leg of the device from the ground adjacent a gate by a handle of a sliding handle on the prop leg such that the prop leg rotates up about a mounting bracket of the device affixed to a lower crossbeam of the gate;

raising the sliding handle of the device toward a distal end of the prop leg;

rotating the prop leg up about the mounting bracket such that the prop leg is positioned nearly parallel to the gate;

lowering the handle onto an upper crossbeam of the gate such that the sliding handle hangs from the upper crossbeam and secures the prop leg to the gate, preventing the distal end of the prop leg from contacting the ground; and thereby, the gate is capable of being closed.

* * * * *